US007739894B2

(12) United States Patent
Suzuki

(10) Patent No.: US 7,739,894 B2
(45) Date of Patent: Jun. 22, 2010

(54) DIE CUSHION CONTROLLER

(75) Inventor: Yuichi Suzuki, Komatsu (JP)

(73) Assignee: Komatsu Ltd., Tokyo (JP)

( * ) Notice: Subject to any disclaimer, the term of this patent is extended or adjusted under 35 U.S.C. 154(b) by 309 days.

(21) Appl. No.: 11/908,488

(22) PCT Filed: Mar. 13, 2006

(86) PCT No.: PCT/JP2006/304859

§ 371 (c)(1),
(2), (4) Date: Sep. 12, 2007

(87) PCT Pub. No.: WO2006/098257

PCT Pub. Date: Sep. 21, 2006

(65) Prior Publication Data

US 2009/0078016 A1 Mar. 26, 2009

(30) Foreign Application Priority Data

Mar. 16, 2005 (JP) ..... 2005-075335

(51) Int. Cl.
*B21J 9/18* (2006.01)

(52) U.S. Cl. ..... 72/454; 72/453.13

(58) Field of Classification Search ..... 72/20.1, 72/20.2, 21.4, 21.5, 28.1, 29.2, 453.13, 454
See application file for complete search history.

(56) References Cited

U.S. PATENT DOCUMENTS 5,435,166 A 7/1995 Sunada
6,085,520 A * 7/2000 Kohno ..... 60/414
7,143,617 B2 * 12/2006 Futamura et al. ..... 72/20.1
7,293,447 B2 11/2007 Iwashita et al.

FOREIGN PATENT DOCUMENTS

EP 1 658 910 A2 5/2006
JP 05-007945 A 1/1993
JP 10-192997 A 7/1998

(Continued)

OTHER PUBLICATIONS

Chinese Office Action dated Jun. 13, 2008 and English translation thereof issued in counterpart Chinese Appln. No. 200680008655.7.

(Continued)

*Primary Examiner*—Edward Tolan
(74) *Attorney, Agent, or Firm*—Frishauf, Holtz, Goodman & Chick, P.C.

(57) ABSTRACT

Provided is a die cushion controller that controls an ascending/descending speed of a die cushion based on a predetermined pressure pattern 56. The pressure pattern 56 has a low pressure target value PL which is first followed by an increased cushion pressure, a high pressure target value PH corresponding to a requisite cushion pressure for retaining a workpiece, and a complementary target value PC which is followed by the cushion pressure at a substantially linear increase rate for a predetermined period of time T2 until the cushion pressure exceeds the low pressure target value PL and reaches the high pressure target value PH. The cushion pressure overshooting the low pressure target value PL continues to follow the complementary target value PC, so that an overshooting amount occurring at a time point at which the cushion pressure reaches the high pressure target value PH can be reduced. As a result, pressure variation in the cushion pressure can be suppressed.

2 Claims, 15 Drawing Sheets

FOREIGN PATENT DOCUMENTS

| | | | |
|---|---|---|---|
| JP | 10-202327 | A | 8/1998 |
| JP | 2001-96314 | A | 4/2001 |

OTHER PUBLICATIONS

German Office Action dated Jul. 15, 2008 and English translation thereof issued in counterpart German Appln. No. P53426HH900KAP.

German Office Action dated Jul. 15, 2008 and English translation thereof issued in counterpart German Appln. No. 112006000606.1.

Notification Concerning Transmittal of International Preliminary Report on Patentability, Chapter I of the Patent Cooperation Treaty, and Written Opinion of the International Searching Authority, dated Sep. 18, 2007 for PCT/JP2006/304859, 4 sheets.

* cited by examiner

DIE CUSHION CONTROLLER

This application is a U.S. National Phase Application under 35 USC 371 of International Application PCT/JP2006/304859 filed Mar. 13, 2006.

TECHNICAL FIELD

The present invention relates to a die cushion controller of a pressing machine used for drawing and the like, in particular, a die cushion controller that controls the operation of a die cushion pad in synchronism with the movement of a slide.

BACKGROUND ART

For example, there has been known a die cushion controller disclosed in Patent Document 1, which controls an ascending/descending movement of a die cushion pad driven by an electric servomotor. In the die cushion controller of Patent Document 1, a load (a pressure) generated in a die cushion pad (hereinafter, this pressure will be referred to as a "cushion pressure") is obtained based on an electric current value of the electric servomotor, and the electric servomotor is controlled such that the obtained cushion pressure follows a pressure pattern of a preset cushion pressure.

In this regard, the pressure pattern as disclosed in Patent Document 1 is in a form of a free-form curve where the cushion pressure starts to gently increase at a time point at which an upper die contacts with a workpiece to reach a maximum target pressure and then gently decreases.

[Patent Document] JP-A-10-202327

DISCLOSURE OF THE INVENTION

Problems to be Solved by the Invention

Depending upon conditions for processing such as a drawing, it is necessary that the cushion pressure should quickly reach a relatively high predetermined target pressure from the time point at which the upper die contacts with the workpiece. To obtain such a target pressure quickly, it is necessary for the pressure pattern to already indicate the predetermined target pressure at the time point at which the upper die contacts with the workpiece.

However, in an attempt to rapidly generate a cushion pressure that corresponds to the high target pressure, overshooting may occur, in which the actually generated cushion pressure exceeds the target pressure to a large degree and subsequently converges down to the target pressure. Thus, due to fluctuations in pressure caused by this overshooting, the workpiece cannot be held securely, resulting in deterioration in molding precision or defective molding.

It is an object of the present invention to provide a die cushion controller which can quickly generate a large cushion pressure required in holding the workpiece and which can suppress fluctuations in cushion pressure to perform molding in a satisfactory manner.

Means for Solving the Problems

A die cushion controller according to an aspect of the present invention includes: a pressure command signal output unit that outputs a pressure command signal in accordance with a pressure target value based on a predetermined pressure pattern; a pressure control unit that outputs a speed command signal based on the pressure command signal; a speed control unit that outputs a motor current command signal based on the speed command signal; and a servo amplifier that supplies an electric current in accordance with the motor current command signal to an electric servomotor which drives a die cushion. In the die cushion controller, a low pressure target value which is first followed by an increased cushion pressure, a high pressure target value corresponding to a requisite cushion pressure for retaining a workpiece, and a complementary target value which is followed by the cushion pressure at a substantially linear increase rate for a predetermined period of time until the cushion pressure exceeds the low pressure target value and reaches the high pressure target value are provided as pressure target values of the pressure pattern.

According to the present invention, the pressure command signal corresponding to the pressure target value output from the pressure command signal output unit is converted to the speed command signal at the pressure control unit, then to the motor current command signal at the speed control unit, and to an electric current value by the servo amplifier to be supplied to the electric servomotor. The electric servomotor is driven by the electric current value so as to generate a predetermined cushion pressure.

As the pressure target values, there are set a low pressure target value, a complementary target value and a high pressure target value, which are followed by the cushion pressure in this order. More specifically, when the upper die contacts with the workpiece, the cushion pressure increases first to follow the low pressure target value. As a result of the increase, the cushion pressure having reached the low pressure target value exceeds the low pressure target value in a slightly overshooting manner. The cushion pressure having exceeded the low pressure target value continues to follow the complementary target value to increase linearly to reach the high pressure target value. Overshooting also occurs at the time point at which the cushion pressure reaches the high pressure target value. However, the overshooting amount is much smaller than the overshooting amount in the case where the cushion pressure converges at a stroke to the high pressure target value from the time point at which the upper die contacts with the workpiece.

Thus, it is possible to reduce the overshooting amount when the cushion pressure converges to the requisite high pressure target value for holding the workpiece, making it possible to suppress fluctuations in pressure to realize an excellent molding. Further, when the cushion pressure reaches the low pressure target value, the cushion pressure does not actually converge to the low pressure target value but continues to increase linearly to converge to the high pressure target value. Therefore, as compared with the case where the cushion pressure converges to the high pressure target value at a stroke, the delay is not so much, making it possible to quickly generate the requisite cushion pressure for holding the workpiece.

EXPLANATION OF CODES

Figure 1:
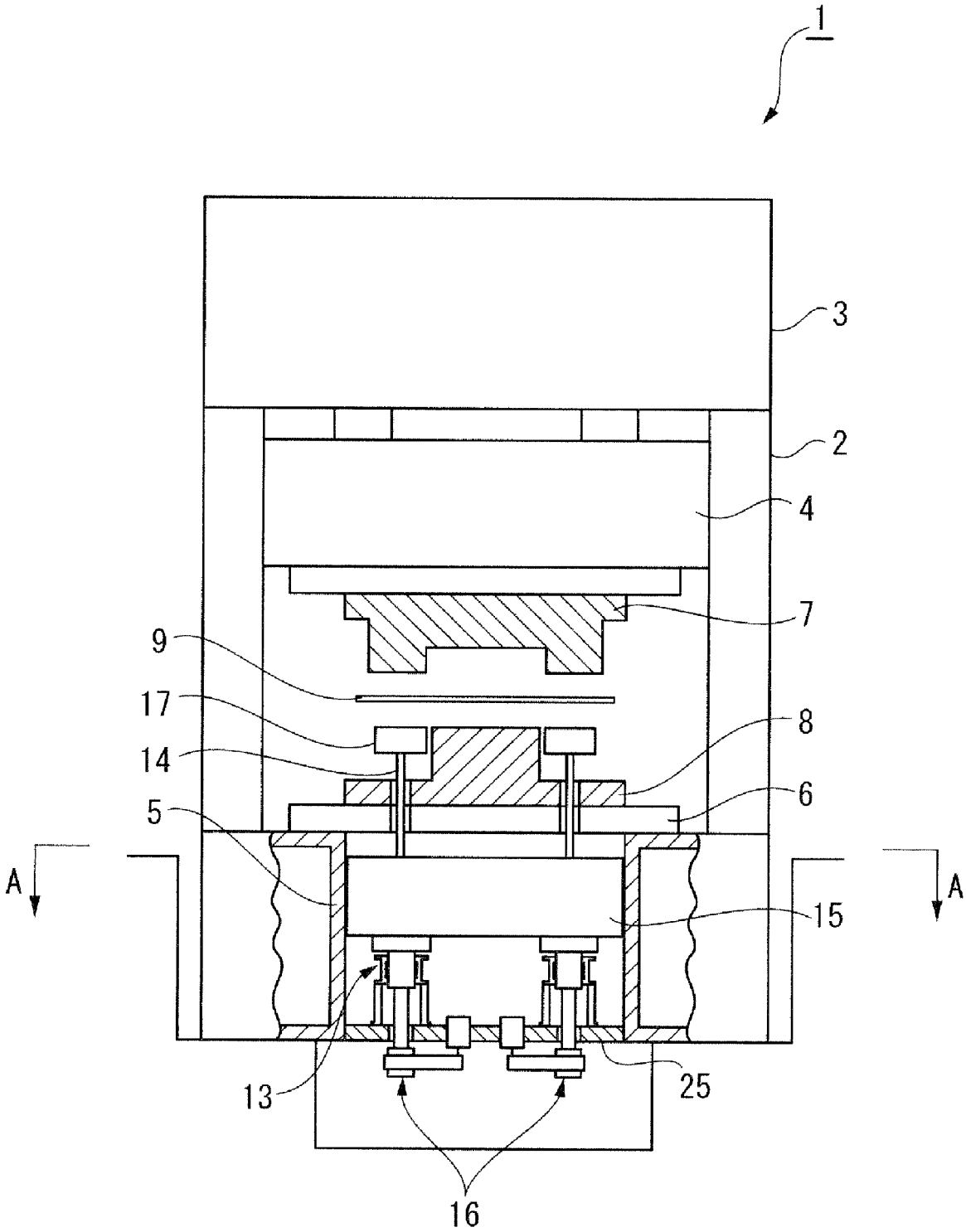
FIG. 1 is a schematic structural view of a pressing machine according to a first embodiment of the present invention.

9: workpiece
13, 13A, 13B: die cushion
21: electric servomotor
40: die cushion controller
42: servo amplifier
48: pressure command signal output unit
50: pressure control unit
53: speed control unit
56: pressure pattern
75: linear servomotor (electric servomotor)
Pc: pressure command signal
υpc: speed command signal
ic: motor current command signal
i: motor current (electric current)
PL: low pressure target value
PH: high pressure target value
PC: complementary target value
T2: time

BEST MODE FOR CARRYING OUT THE INVENTION

Next, specific embodiments of a die cushion controller of the present invention will be described with reference to the drawings.

First Embodiment

Figure 2:
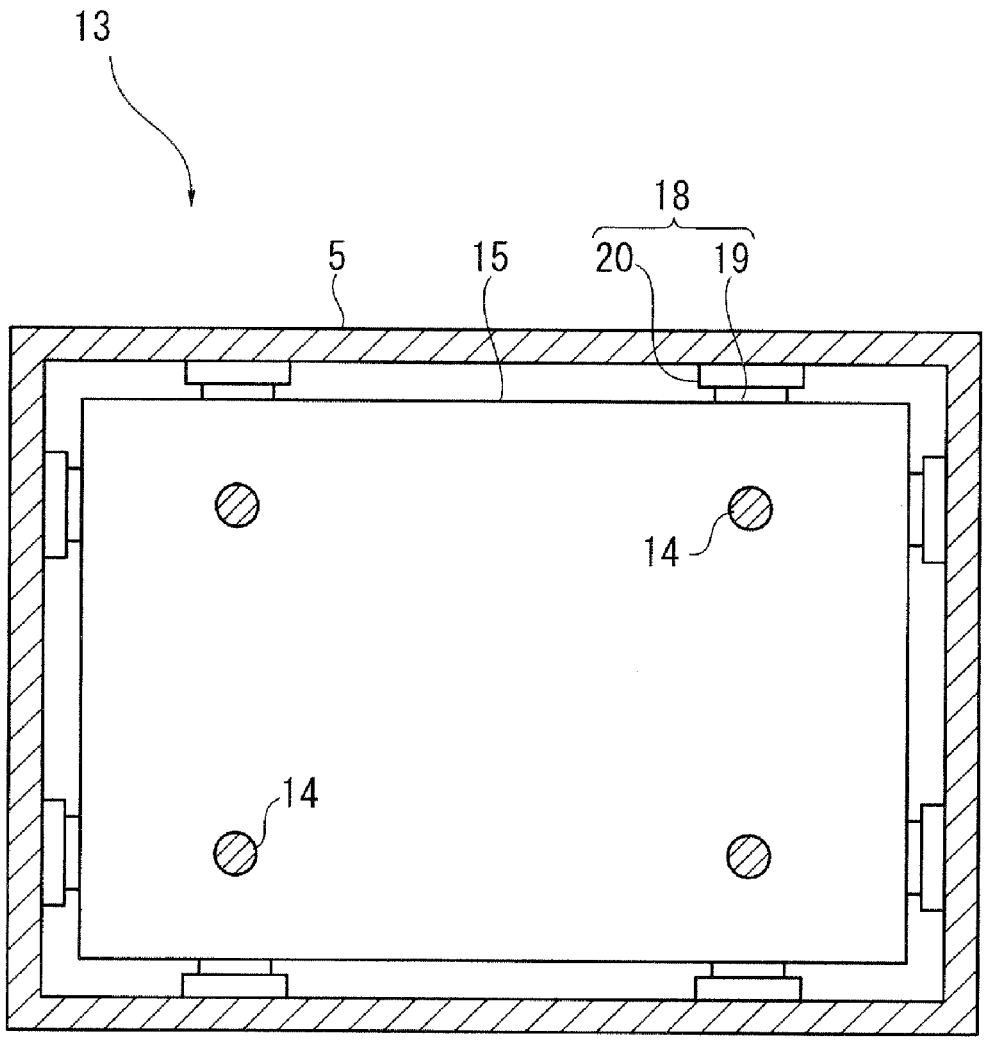
FIG. 2 is a sectional view of a primary portion taken along the arrow line A-A in FIG. 1.
Figure 3:
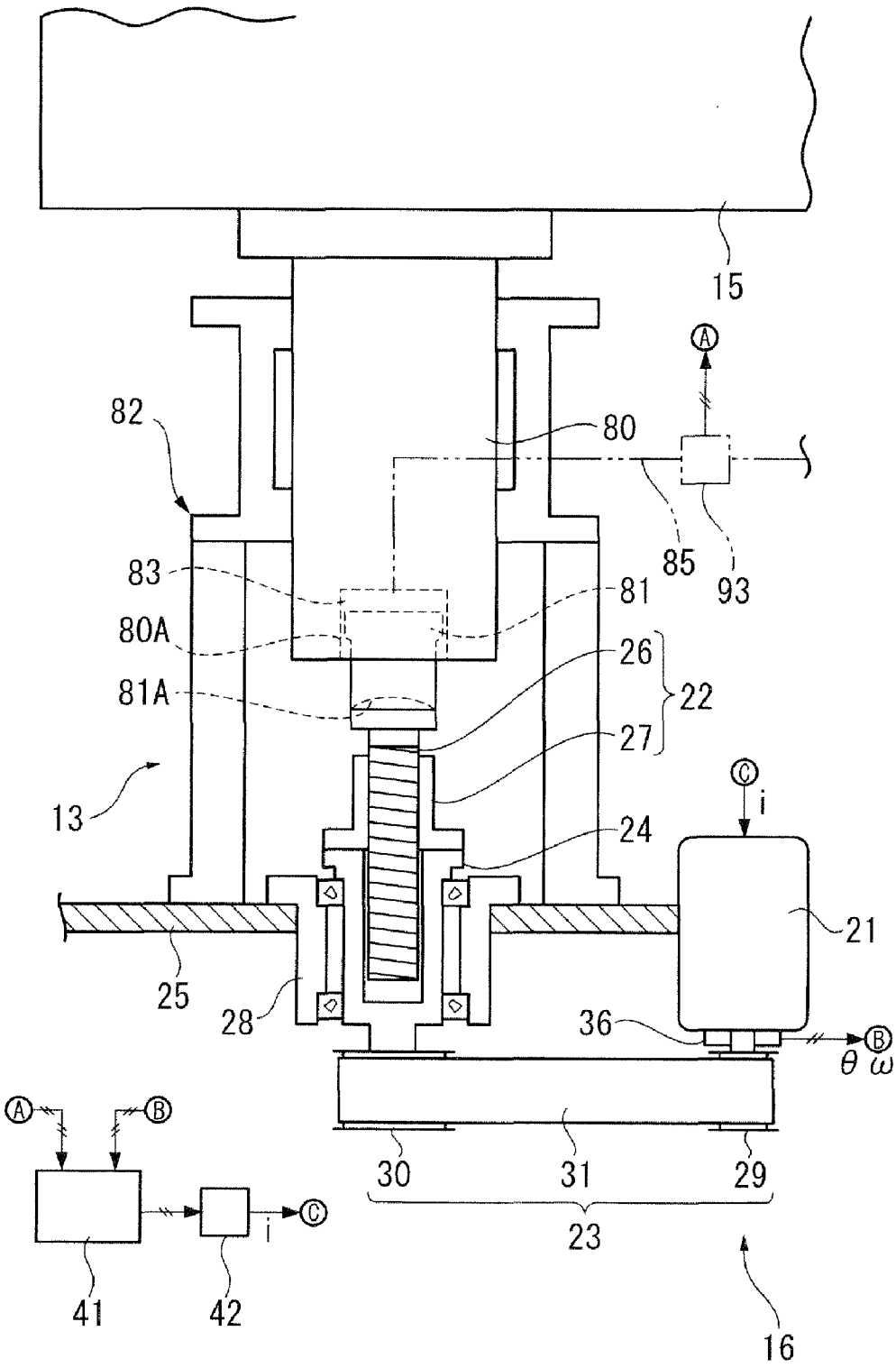
FIG. 3 is a schematic structural view of a die cushion according to the first embodiment.

FIG. 1 is a schematic structural view of a pressing machine according to a first embodiment of the present invention. FIG. 2 is a sectional view of a primary portion taken along the arrow line A-A in FIG. 1. FIG. 3 is a schematic structural view of a die cushion according to the first embodiment.

FIG. 1 shows a pressing machine 1 which is equipped with a slide 4 driven to ascend and descend by a slide drive mechanism 3 supported by a main body frame 2 so as to be capable of ascending and descending, and a bolster 6 opposed to the slide 4 and mounted to a bed 5. An upper die 7 is mounted to a lower surface of the slide 4, and a lower die 8 is mounted to an upper surface of the bolster 6. Thus, press processing (drawing) is performed on a workpiece 9 arranged between the upper die 7 and the lower die 8 by an ascent/descent movement of the slide 4.

In this structure, a die cushion 13 is built in the bed 5. The die cushion 13 is equipped with a requisite number of die cushion pins 14, a die cushion pad 15 supported within and by the bed 5 so as to be capable of ascending and descending, and die cushion pad drive mechanism 16 that raises and lowers the die cushion pad 15.

The die cushion pins 14 are passed through holes formed in the bolster 6 and the lower die 8 so as to extend therethrough in an up-down direction. The upper end of each die cushion pin 14 abuts a blank holder 17 arranged in a recess of the lower die 8, and the lower end thereof abuts the die cushion pad 15.

As shown in FIG. 2, between each side surface of the die cushion pad 15 and the inner wall surface of the bed 5 opposed thereto, there are provided one or more (two in this embodiment) guide members 18 vertically guiding the die cushion pad 15. Each guide member 18 includes a pair of inner guide 19 and outer guide 20 which are engaged with each other. The inner guide 19 is attached to each side surface of the die cushion pad 15, and the outer guide 20 is attached to the inner wall surface of the bed 5. Thus, the die cushion pad 15 is supported within and by the bed 5 so as to be capable of ascending and descending.

As shown in FIG. 3, the die cushion pad drive mechanism 16 is equipped with an electric servomotor 21 as a drive source, a ball screw mechanism 22 as a means for raising and lowering the die cushion pad 15, and a belt transmission mechanism 23 and a connecting member 24 that are arranged in a power transmission route between the electric servomotor 21 and the ball screw mechanism 22 such that power of the die cushion pad 15 and power of the electric servomotor 21 are mutually transmitted therebetween.

The electric servomotor 21 is a rotary AC servomotor having a rotation shaft; a rotating speed and a torque of the rotation shaft are controlled under the control of a motor current (electric current) i supplied to the electric servomotor 21. The main body portion of the electric servomotor 21 is fixed to a beam 25 extended between the inner wall surfaces of the bed 5. Further, an encoder 36 is added to the electric servomotor 21. The encoder 36 detects an angle and an angular velocity of the rotation shaft of the electric servomotor 21, and outputs detection values as a motor rotation angle detection signal θ and a motor rotation angular velocity detection signal ω, respectively. The motor rotation angle detection signal θ and the motor rotation angular velocity detection signal ω output from the encoder 36 are input to a controller 41 described below.

The ball screw mechanism 22 includes a screw portion 26 and a nut portion 27 threadedly engaged therewith, and has a function to convert by the screw portion 26 rotational power input from the nut portion 27 to linear power and to output the converted linear power. A lower end portion of the screw portion 26 is arranged so as to be capable of advancing and retreating within a space formed in a central portion of the connecting member 24, and a lower end portion of the nut portion 27 is connected to an upper end portion of the connecting member 24. The connecting member 24 is supported by the beam 25 with interposition of a bearing device 28 including requisite bearings and a bearing housing accommodating the bearings.

The belt transmission mechanism 23 is formed by a small pulley 29 fixed to the rotation shaft of the electric servomotor 21, a large pulley 30 fixed to the lower end portion of the connecting member 24, and a timing belt 31 stretched between the pulleys.

In the above-mentioned structure, the rotational power of the electric servomotor 21 is transmitted to the nut portion 27 of the ball screw mechanism 22 via the small pulley 29, the timing belt 31, the large pulley 30, and the connecting member 24, and the screw portion 26 of the ball screw mechanism 22 is moved in the vertical direction by the rotational power transmitted to the nut portion 27, whereby the die cushion pad 15 is caused to ascend and descend. By controlling the motor current i supplied to the electric servomotor 21, a biasing force applied to the die cushion pad 15 is controlled.

In the die cushion 13, a plunger rod 80 is connected to a lower end portion of the die cushion pad 15. A side surface of the plunger rod 80 is slidably supported by a cylindrical plunger guide 82. The plunger guide 82 has a function to guide the plunger rod 80 and the die cushion pad 15 connected to the plunger rod 80 in an ascending/descending direction. In the lower portion of the plunger rod 80, there is formed a cylinder 80A having a downwardly directed opening; a piston 81 is slidably accommodated in the cylinder 80A.

A hydraulic chamber 83 is formed by an inner wall surface of the cylinder 80A and an upper surface of the piston 81, and the hydraulic chamber 83 is filled with pressure oil. The axis of the hydraulic chamber 83 coincides with the axes of the plunger rod 80 and the ball screw mechanism 22. A pressure oil port of the hydraulic chamber 83 is connected to a hydraulic circuit shown in FIG. 4, and the pressure oil is exchanged between the hydraulic chamber 83 and the hydraulic circuit. The pressure oil of the hydraulic chamber 83 mitigates an impact generated when the upper die 7 contacts with the workpiece 9. When the oil pressure becomes equal to or higher than a predetermined value, the pressure oil is discharged into a tank 91 (see FIG. 4). Thus, the pressure oil of the hydraulic chamber 83 has an overload protection function.

The lower end of the piston 81 abuts an upper end of the screw portion 26 of the ball screw mechanism 22. A spherical concave surface 81A is formed at the lower end of the piston 81, and a spherical convex surface is formed at the upper end of the screw portion 26 opposed to the concave surface 81A. However, it is also possible to form a convex surface at the lower end of the piston 81 and form a concave surface at the upper end of the screw portion 26C. While a bar-like member such as the screw portion 26 is resistant to an axial force applied to an end portion thereof, it is vulnerable to bending moment. When the upper end of the screw portion 26 has a spherical shape, even when the die cushion pad 15 is inclined to generate bending moment at the upper end of the screw portion 26, only an axial force is applied to the screw portion 26 as a whole. With this structure, it is possible to prevent damage of the screw portion 26C on account of an eccentric load.

In the die cushion 13, the pressure of the hydraulic chamber 83 is detected in the above-mentioned hydraulic circuit. In the hydraulic circuit diagram of FIG. 4, the port of the hydraulic chamber 83 is connected to one port of a supply side control valve 86 and one port of a discharge side control valve 87 via a duct 85. The other port of the supply side control valve 86 is connected to a discharge port of a hydraulic pump 89 via a duct 88. An inlet port of the hydraulic pump 89 is connected to the tank 91 via a duct 90. The other port of the discharge side control valve 87 is connected to the tank 91 via a duct 92. The supply side control valve 86 is opened only when hydraulic fluid of the tank 91 is supplied to the hydraulic chamber 83, and the discharge side control valve 87 is opened only when the pressure oil of the hydraulic chamber 83 is discharged into the tank 91.

A pressure gage 93 is provided in the duct 85. The pressure gage 93 detects the pressure of the hydraulic chamber 83, that is, the load generated in the die cushion pad 15. A pressure detection signal Pr is output from the pressure gage 93 to a pressure comparing unit 49 of the controller 41 and to a pressure shaft control unit 94. The pressure comparing unit 49 will be described below. The pressure shaft control unit 94 inputs the pressure detection signal Pr from the pressure gage 93, and outputs a control signal to the supply side control valve 86 and the discharge side control valve 87 to control an opening/closing of the control valves 86, 87.

Figure 4:
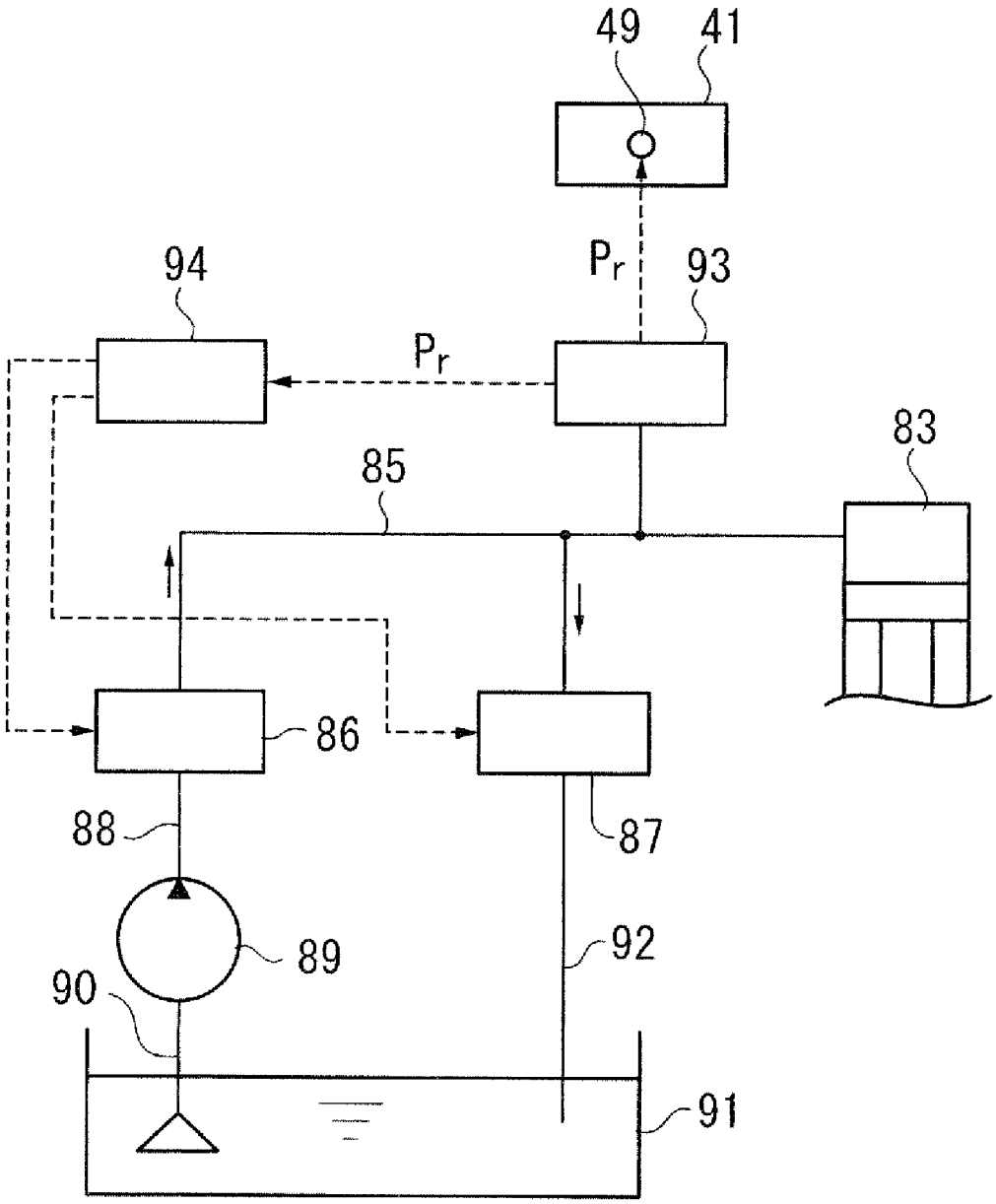
FIG. 4 is a hydraulic circuit diagram related to the die cushion.

The hydraulic circuit shown in FIG. 4 has an overload preventing function. That is, when the upper die 7 and the workpiece 9 contact with each other to generate a load in the die cushion pad 15, the pressure of the hydraulic chamber 83 increases. When the detection value of the pressure gage 93 exceeds a predetermined value, there is a fear of overload generation. In such cases, an opening signal is output from the pressure shaft control unit 94 to the discharge side control valve 87, and the discharge side control valve 87 is opened. Then, the pressure oil of the hydraulic chamber 83 is discharged into the tank 91. Then, a system (not shown) operates to effect emergency stop of the operation of the pressing machine 1. In this way, the pressing machine 1 stops upon discharge of the pressure oil from the hydraulic chamber 83, so that generation of an overload is prevented.

Further, it is also possible to provide a relief valve in place of the discharge side control valve 87; when the pressure of the hydraulic chamber 83 exceeds a predetermined pressure, the relief valve operates to discharge pressure oil.

Next, the structure of a die cushion controller 40 that controls the die cushion 13 will be described with reference to the block diagram of FIG. 5.

Figure 5:
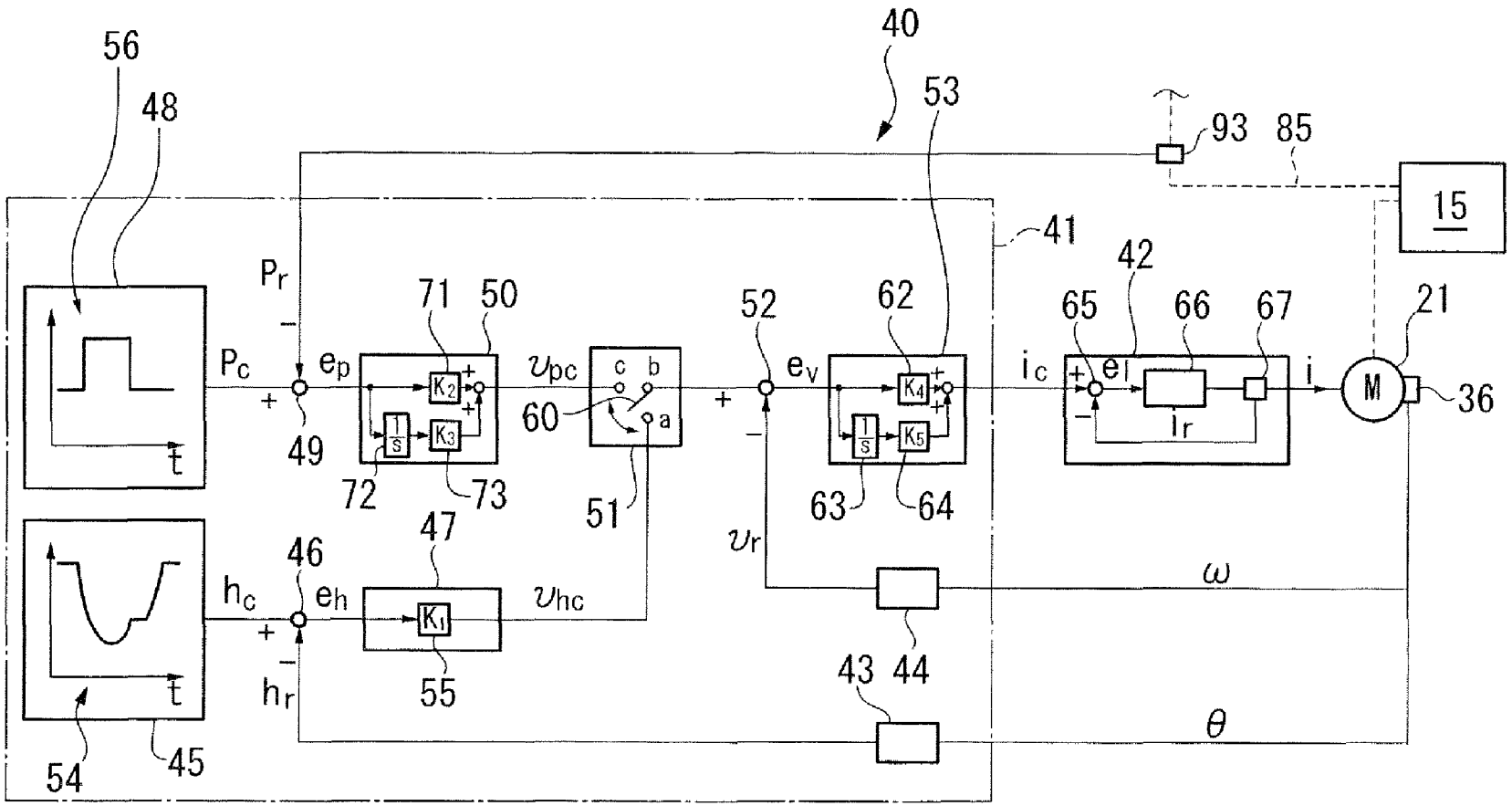
FIG. 5 is a block diagram illustrating a structure of a die cushion controller according to the first embodiment.

The die cushion controller 40 shown in FIGS. 5 is equipped with the controller 41, and a servo amplifier 42 that supplies the electric servomotor 21 with the electric current i in accordance with a motor current command signal ic output from the controller 41.

Although not described in detail with reference to a drawing, the controller 41 is equipped with an input interface that transforms/shapes various input signals, a computer apparatus mainly constituted by a microcomputer, a high speed numerical computing processor and the like and adapted to execute arithmetical/logical operation on input data in predetermined procedure, and an output interface that converts an operation result into a control signal and outputs the control signal. In the controller 41, various functional units such as a die cushion pad position computing unit 43, a die cushion pad speed computing unit 44, a position command signal output unit 45, a position comparing unit 46, a position control unit 47, a pressure command signal output unit 48, a pressure comparing unit 49, a pressure control unit 50, a position/pressure control switching unit 51, a speed comparing unit 52 and a speed control unit 53.

The die cushion pad position computing unit 43 has a function to be input with the motor rotation angle detection signal θ from the encoder 36 provided on the electric servomotor 21, to obtain a position of the die cushion pad 15 based on this input signal in a predetermined relationship with the motor rotation angle and to output the result as a die cushion pad position detection signal hr.

The die cushion pad speed computing unit 44 has a function to be input with the motor rotation angular velocity detection signal ω from the encoder 36, to obtain a speed (ascending/descending speed) of the die cushion pad 15 based on the input signal in a predetermined relationship with the motor rotating speed, and to output the result as a die cushion pad speed detection signal υr.

The position command signal output unit 45 has a function to obtain a position target value for the die cushion pad 15 by referring to a preset positional pattern 54, and to generate/output a positional command signal hc based on the obtained target value. Here, the positional pattern 54 indicates a desired correlation between time (or press angle or slide position) and the die cushion pad position.

The position comparing unit 46 has a function to compare the position command signal hc from the position command signal output unit 45 with the die cushion pad position detection signal hr from the die cushion pad position computing unit 43, and to output a position deviation signal eh.

The position control unit 47 is equipped with a coefficient multiplier 55 inputting the position deviation signal eh from the position comparing unit 46 and multiplying the input signal by a predetermined position gain $K_1$ to output the result, and has a function to generate/output a speed command signal υhc of a magnitude corresponding to the position deviation signal eh.

The pressure command signal output unit 48 has a function to obtain a pressure (cushion pressure) target value generated at the die cushion pad 15 by referring a preset pressure pattern 56, and to generate/output a pressure command signal Pc based on the obtained pressure target value. Here, the pressure pattern 56 indicates a desired correlation between time (instead, press angle or slide position) and the pressure generated in the die cushion pad 15.

The pressure comparing unit 49 has a function to compare the pressure command signal Pc from the pressure command signal output unit 48 with the pressure detection signal Pr from the pressure gage 93 to output a pressure deviation signal ep.

The pressure control unit 50 is equipped with a coefficient multiplier 71 that is input with the pressure deviation signal ep from the pressure comparing unit 49 and multiplies the input signal by a predetermined proportional gain $K_2$ to output the result, an integrator 72 that is input with the pressure deviation signal ep from the pressure comparing unit 49 and integrates the input signal to output the result (the symbol s in the block diagram indicates a Laplace operator), and a coefficient multiplier 73 that is input with the output signal from the integrator 72 and multiplies the input signal by a predetermined integral gain $K_3$ to output the result, the pressure control unit 50 having a function to add the output signal from the coefficient multiplier 73 to the output signal from the coefficient multiplier 71 and to generate/output a speed command signal υpc.

In the pressure control unit 50, there is conducted a proportional+integral action (PI action) in which a proportional action (P action) and an integral action (I action) are combined with each other, whereby there is output from the pressure control unit 50 a speed command signal υpc which is of a magnitude corresponding to the pressure deviation signal ep and whose magnitude increases as long as the pressure deviation signal ep exists, with the detected pressure being quickly and correctly matched with the target pressure.

The position/pressure control switching unit 51 is adapted to effect switching between position control for controlling the position of the die cushion pad 15 and pressure control for controlling the pressure generated in the die cushion pad 15, and is equipped with a switch 60 that effects switching between an a-contact and a c-contact using a b-contact as the reference. When the b-contact and the a-contact are connected with each other by the switch 60 (hereinafter, this connecting operation will be referred to as "b-a contact connecting operation"), the speed command signal υhc from the position control unit 47 is supplied to the speed comparing unit 52. When the b-contact and the c-contact are connected with each other by the switch 60 (hereinafter, this connecting operation will be referred to as "b-c contact connecting operation"), the speed command signal υpc from the pressure control unit 50 is supplied to the speed comparing unit 52.

In this embodiment, when a first switching time (indicated at t2 in FIG. 6) at which the upper die 7 and the workpiece 9 contact with each other is detected, switching is effected from the position control to the pressure control through switching operation at the position/pressure control switching unit 51, and when a second switching time (indicated at t3 in FIG. 6) at which the die cushion pad 15 reaches a bottom dead center is detected, switching is effected from the pressure control to the position control through switching operation at the position/pressure control switching unit 51.

Here, the first switching time is when the pressure detection value obtained by the pressure gage 93 reaches a first threshold value during descent of the die cushion pad 15 (i.e., the case in which the upper die 7 and the workpiece 9 are held in contact with each other to start to generate pressure the die cushion pad 15) or when the detection position as obtained by the die cushion pad position detecting encoder 36 reaches a first predetermined position (i.e., the case in which the die cushion pad 15 reaches the position where the upper die 7 and the workpiece 9 are held in contact with each other). The second switching time is when the pressure detection value as obtained by the pressure gage 93 reaches a second threshold value during descent of the die cushion pad 15 (i.e., the case in which the upper die 7 and the workpiece 9 are separated from each other to eliminate the pressure in the die cushion pad 15) or when the detection position as obtained by the die cushion pad position detecting encoder 36 reaches a second predetermined position (i.e., the case in which the die cushion pad 15 reaches the bottom dead center).

When the position control is selected through switching operation by the position/pressure control switching unit 51, the speed comparing unit 52 has a function to compare the speed command signal υhc from the position control unit 47 and the die cushion pad speed detection signal υr from the die cushion pad speed computing unit 44, and to output the speed deviation signal ev. When the pressure control is selected through switching operation by the position/pressure control switching unit 51, the speed comparing unit 52 has a function to compare the speed command signal υpc from the pressure control unit 50 and the die cushion pad speed detection signal υr from the die cushion pad speed computing unit 44, and to output the speed deviation signal ev.

According to this embodiment, during the pressure control, there is output from the pressure control unit 50 the speed command signal υpc which is of a magnitude corresponding to the pressure deviation signal ep and whose magnitude increases as long as the pressure deviation signal ep exists, so that it is possible to reduce the pressure deviation quickly and reliably. Thus, it is possible to improve the accuracy of the pressure control.

The speed control unit 53 is equipped with a coefficient multiplier 62 that is input with the speed deviation signal ev from the speed comparing unit 52 and multiplies the input signal by a predetermined proportional gain $K_4$ to output the result, an integrator 63 that is input with the speed deviation signal ev from the speed comparing unit 52 and integrates the input signal to output the result (the symbol s in the block diagram indicates a Laplace operator), and an coefficient multiplier 64 that is input with the output signal from the integrator 63 and multiplies the input signal by a predetermined integral gain $K_5$ to output the result, the speed control unit 53 having a function to add the output signal from the coefficient multiplier 64 to the output signal from the coefficient multiplier 62 to generate/output a motor current command signal (torque command signal) ic.

In the speed control unit 53, there is conducted a proportional+integral action (PI action) in which a proportional action (P action) and an integral action (I action) are combined with each other, whereby there is output from the speed control unit 53 a motor current command signal ic which is of a magnitude corresponding to the speed deviation signal ev and whose magnitude increases as long as the speed deviation signal ev exists, and the detection speed coincides with the target speed quickly and accurately. Thus, stable position/pressure control can be effected.

The servo amplifier 42 is equipped with a current comparing unit 65, a current control unit 66, and a current detecting unit 67. In the servo amplifier 42, the current detecting unit 67 detects the motor current i supplied to the electric servomotor 21, and outputs the detection value as a motor current detection signal ir. The current comparing unit 65 compares the motor current command signal ic from the speed control unit 53 and the motor current detection signal ir from the current detecting unit 67, and outputs a motor current deviation signal ei. The current control unit 66 controls the motor current i to be supplied to the electric servomotor 21 based on the motor current deviation signal ei from the current comparing unit 65.

Figure 6:
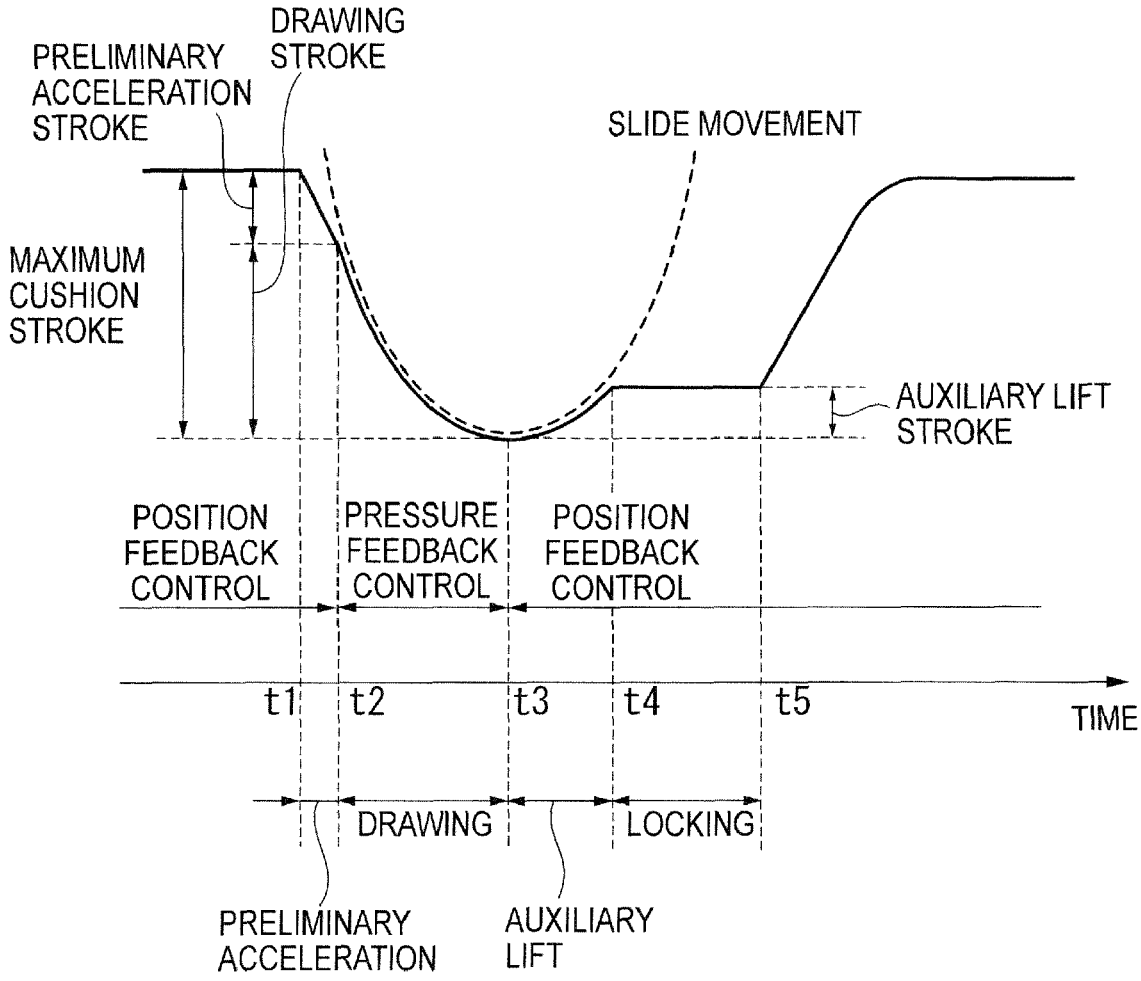
FIG. 6 is a diagram illustrating an operation of a slide and a die cushion pad.

Next, the relationship between the operation of the die cushion pad 15 and the pressure/position control will be described in the following with reference to FIGS. 5 and 6. FIG. 6 is a diagram illustrating the operation of the slide 4 and of the die cushion pad 15; the chart indicates how the positions of the slide 4 and the die cushion pad 15 vary with passage of time.

In the following description, the die cushion pad position detection signal hr from the die cushion pad position computing unit 43 will be referred to as "position feedback signal hr", the die cushion pad speed detection signal υr from the die cushion pad speed computing unit 44 will be referred to as "speed feedback signal υr", and the pressure detection signal Pr from the pressure gage 93 will be referred to as "pressure feedback signal Pr". Further, the position control will be referred to as "position feedback control", and the pressure control will be referred to as "pressure feedback control".

In this embodiment, in order to mitigate the impact when the upper die 7 and the workpiece 9 contact with each other, preliminary acceleration is effected on the die cushion pad 15 from time t1 to time t2. From time t1 to time t2, the b-contact and the a-contact in the position/pressure control switching unit 51 are connected by the switch 60 to perform position feedback control.

During this position feedback control, the position comparing unit 46 subtracts the position feedback signal hr from the position command signal hc to output the position deviation signal eh, the position control unit 47 outputs the speed command signal υhc reducing the position deviation signal eh, the speed comparing unit 52 subtracts the speed feedback signal υr from the speed command signal υhc to output the speed deviation signal ev, the speed control unit 53 outputs the motor current command signal (torque command signal) ic reducing the speed deviation signal ev, and the servo amplifier 42 supplies the electric servomotor 21 with the motor current i corresponding to the motor current command signal ic. As a result, the position of the die cushion pad 15 is controlled such that the position detection value obtained by the encoder 36 is in conformity with the preset positional pattern 54.

Next, when the upper die 7 and the workpiece 9 contact with each other at time t2 (the first switching time), the b-contact and the c-contact are connected by the switch 60 through b-c contact connecting operation at the position/pressure control switching unit 51 to effect switching from position feedback control to pressure feedback control. From time t2 to time t3, the slide 4 and the die cushion pad 15 descend integrally to perform drawing on the workpiece 9. From time t2 to time t3, pressure feedback control is effected.

During this pressure feedback control, the pressure comparing unit 49 subtracts the pressure feedback signal Pr from the pressure command signal Pc to output the pressure deviation signal ep, the pressure control unit 50 outputs the speed command signal υpc reducing the pressure deviation signal ep, the speed comparing unit 52 subtracts the speed feedback signal υr from the speed command signal υpc to output the speed deviation signal ev, the speed control unit 53 outputs the motor current command signal (torque command signal) ic reducing the speed deviation signal ev, and the servo amplifier 42 supplies the electric servomotor 21 with the motor current i corresponding to the motor current command signal ic. As a result, the cushion pressure of the die cushion pad 15 is controlled such that the pressure detection value obtained by the pressure gage 93 is in conformity with the preset pressure pattern 56.

Next, when the slide 4 and the die cushion pad 15 reach the bottom dead center at time t3 (the second switching time), the b-contact and the a-contact are connected by the switch 60 through b-a contact connecting operation at the position/pressure control switching unit 51, and switching effected from pressure feedback control to position feedback control. From time t3 to time t4, the slide 4 and the die cushion pad 15 ascend integrally by an amount corresponding to the auxiliary lift. From time t4 to time t5, the die cushion pad 15 is locked and the ascending motion is temporarily stopped. At time t5, the die cushion pad 15 restarts the ascending motion. From time t3 onward, position feedback control is effected, and, through the various signal flows as described above, the position of the die cushion pad 15 is controlled such that the position detection value as obtained by the encoder 36 follows the preset position pattern 54.

In the following, the pressure pattern 56 indicating the target pressure at the time of pressure feedback control and the actually generated cushion pressure will be described in detail with reference to FIGS. 7 through 10.

Figure 7:
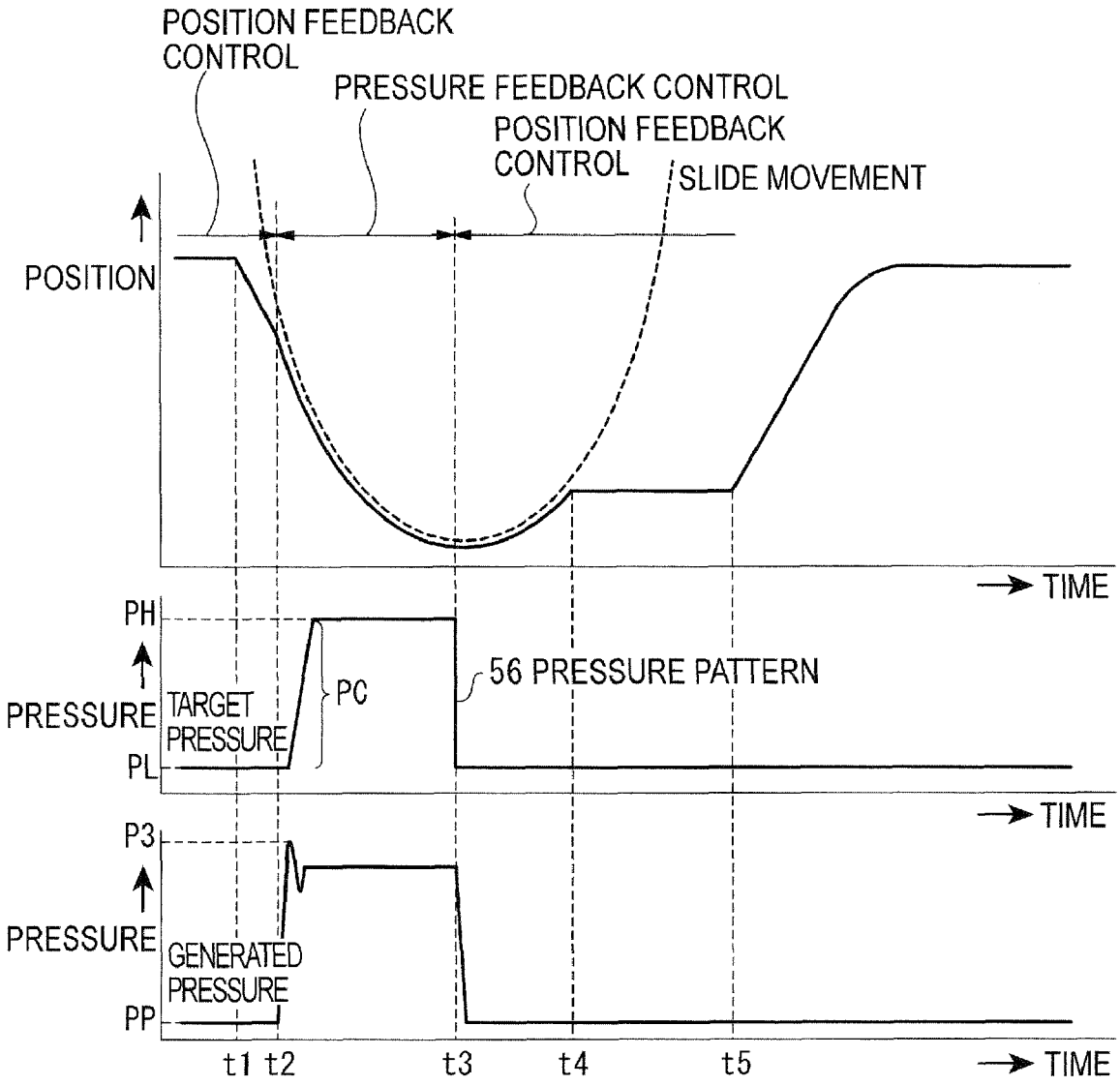
FIG. 7 is an explanatory view illustrating a target pressure and a generated pressure (cushion pressure)

As shown in FIG. 7, the target pressure in this embodiment is set to the low pressure target value PL at a point in time at which time t2 has been slightly passed, that is, until a predetermined period of time has elapsed after switching from position feedback control to pressure feedback control. After that, the target pressure is changed obliquely with a predetermined time constant, and, during the period of time until time t3, during which pressure feedback control is effected, it is set to the high pressure target value PH, which is the pressure value at the time of drawing. From the time t3 onward, the target pressure is set to the low pressure target value PL while position feedback control is effected again.

As the actual cushion pressure in the die cushion pad 15, there is generated a pre-load PP until time t2 when the upper die 7 touches the workpiece 9. When time t2 is reached and the upper die 7 contacts with the workpiece 9, the actual cushion pressure increases at first toward the low pressure target value PL. Further, the actual cushion pressure continues to increase toward the high pressure target value PH. After the actual cushion pressure reaches the high pressure target value PH, the actual cushion pressure maintains the value. When, from time t3 onward, switching is effected to position feedback control, the cushion pressure is lowered to the pre-load PP again.

Figure 8:
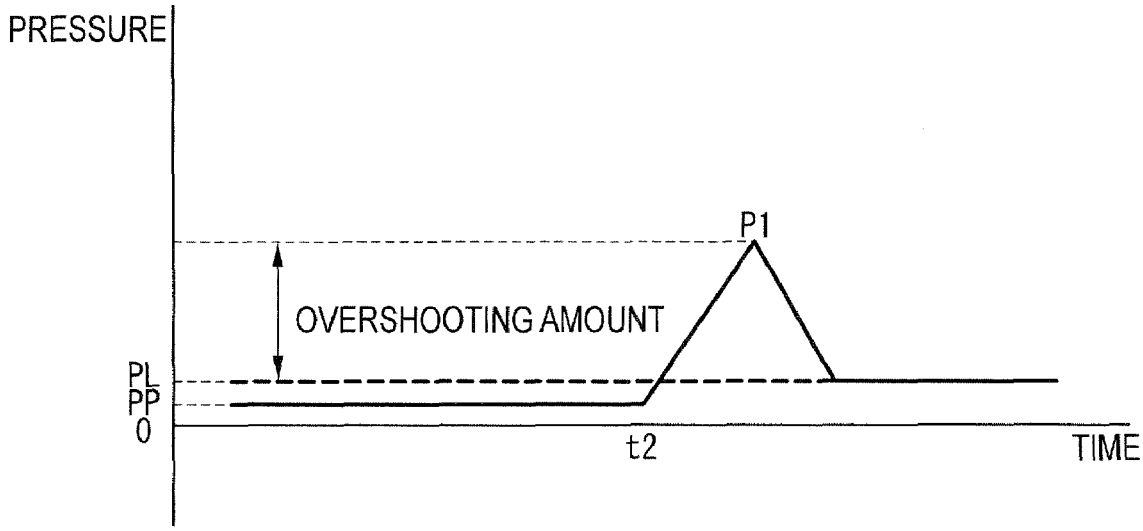
FIG. 8 is an explanatory view illustrating a relationship between a low pressure target value and the generated pressure.
Figure 9:
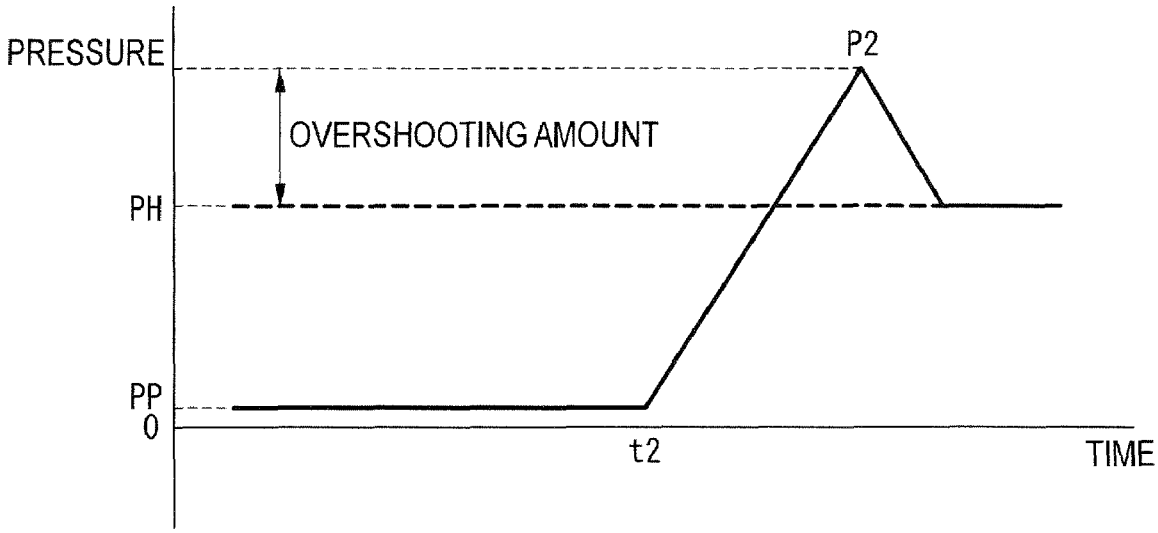
FIG. 9 is an explanatory view illustrating a relationship between a high pressure target value and the generated pressure.

FIGS. 8 and 9 are schematic diagrams for illustrating the operation of this embodiment.

In FIG. 8, the target pressure of the cushion pressure is constantly set to the low pressure target value PL. In this case, when the upper die 7 contacts with the workpiece 9 at time t2, the actual cushion pressure increases from the pre-load PP toward the low pressure target value PL. After overshooting the low pressure target value PL, the actual cushion pressure converges to the low pressure target value PL. The low pressure side maximum pressure at the time of overshooting is P1.

In contrast, in FIG. 9, the target pressure is constantly set to the high pressure target value PH. Also in this case, when the upper die 7 contacts with the workpiece 9 at time t2, the actual cushion pressure increases from the pre-load PP toward the high pressure target value PH. After overshooting the high pressure target value PH, the actual cushion pressure converges to the high pressure target value PH. The high pressure side maximum pressure at the time of overshooting is P2.

However, on the low pressure side and the high pressure side, the overshooting amount as measured from the low pressure target value PL is the same as the overshooting amount as measured from the high pressure target value PH.

Figure 10:
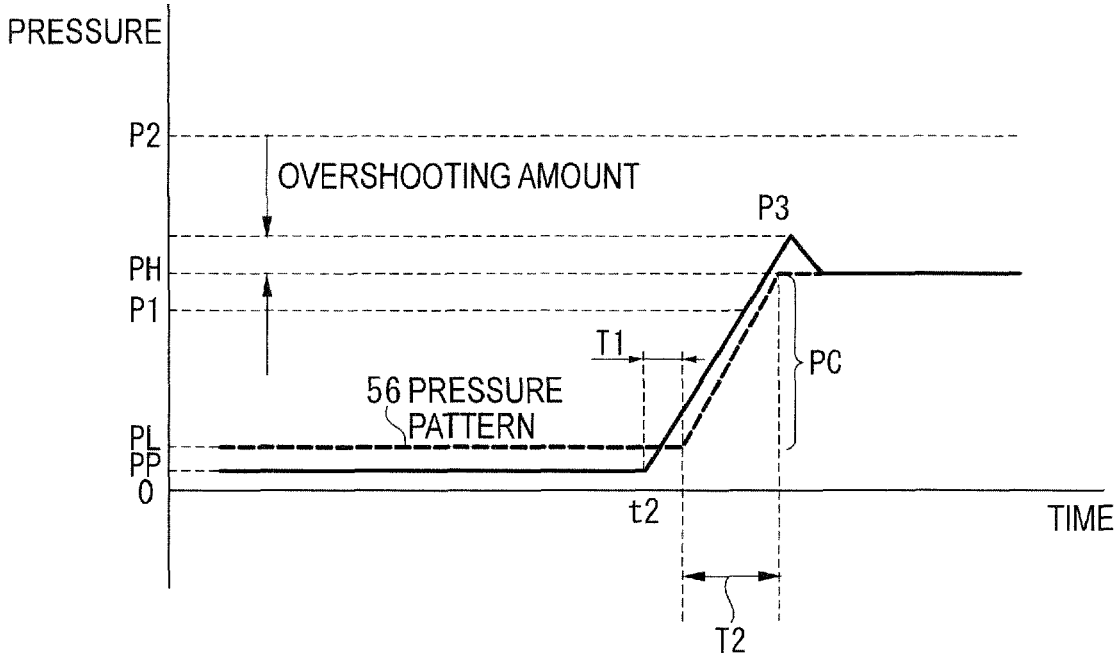
FIG. 10 is an explanatory view illustrating a relationship between a pressure pattern and the generated pressure in the first embodiment.

In this embodiment, taking into account the above-mentioned characteristics, overshooting is suppressed, and the pressure pattern 56 is set as shown in FIG. 10 so that the actual cushion pressure quickly converges to the proper high pressure target value PH at the time of drawing. The pressure pattern 56 shown in FIG. 10 is the same as that shown in FIG. 7 and only the primary portion thereof is depicted with the time axis extended to facilitate understanding. That is, as described above, in the pressure pattern 56 of this embodiment, even after switching is effected at time t2 from position feedback control to pressure feedback control, the cushion pressure is set to the low pressure target value PL until a short period of time T1 has elapsed. After that, during a predetermined period of time T2, the target pressure undergoes a substantially linear change; and then, during pressure feedback control, the target pressure is set to the high pressure target value PH. The target pressure between the low pressure target value PL and the high pressure target value PH corresponds to the complementary target value PC.

As stated above, the high pressure target value PH is set to an optimum value for drawing according to the processing conditions for the workpiece 9, whereas the low pressure target value PL is set to a value which is larger than the pre-load PP and which causes the low pressure side maximum pressure P1 that can be generated when the cushion pressure is converged to the low pressure target value PL to be smaller than the high pressure target value PH.

As indicated by the solid line in FIG. 10, in the case in which the pressure pattern 56 is set as described above, when the upper die 7 contacts with the workpiece 9 at time t2, the cushion pressure starts to increase from the pre-load PP, and switching is effected from position feedback control to pressure feedback control. The cushion pressure increases toward the low pressure target value during the short period of time T1. However, at the point in time when the period of time T1 has elapsed, the cushion pressure exceeds the low pressure target value PL in an overshooting manner. After that, the cushion pressure continues to increase at a substantially linear increase rate along the obliquely raised complementary target value PC. Next, at the point in time when the period of time T2 has elapsed, the cushion pressure overshoots the high pressure target value PH, eventually converging to the high pressure target value PH. However, the high pressure side maximum pressure P3 in the case in which overshooting occurs on the high pressure side is much smaller than the above-mentioned high pressure side maximum pressure P2 generated in the case in which the cushion pressure is caused to directly converge toward the high pressure target value PH from the pre-load PP. Thus, it is possible to substantially reduce the overshooting amount and to cause the cushion pressure to quickly converge to the high pressure target value PH, making it possible to suppress vibration of the die cushion pad 15 caused by fluctuations in pressure and to realize a drawing of higher precision.

Second Embodiment

Figure 11:
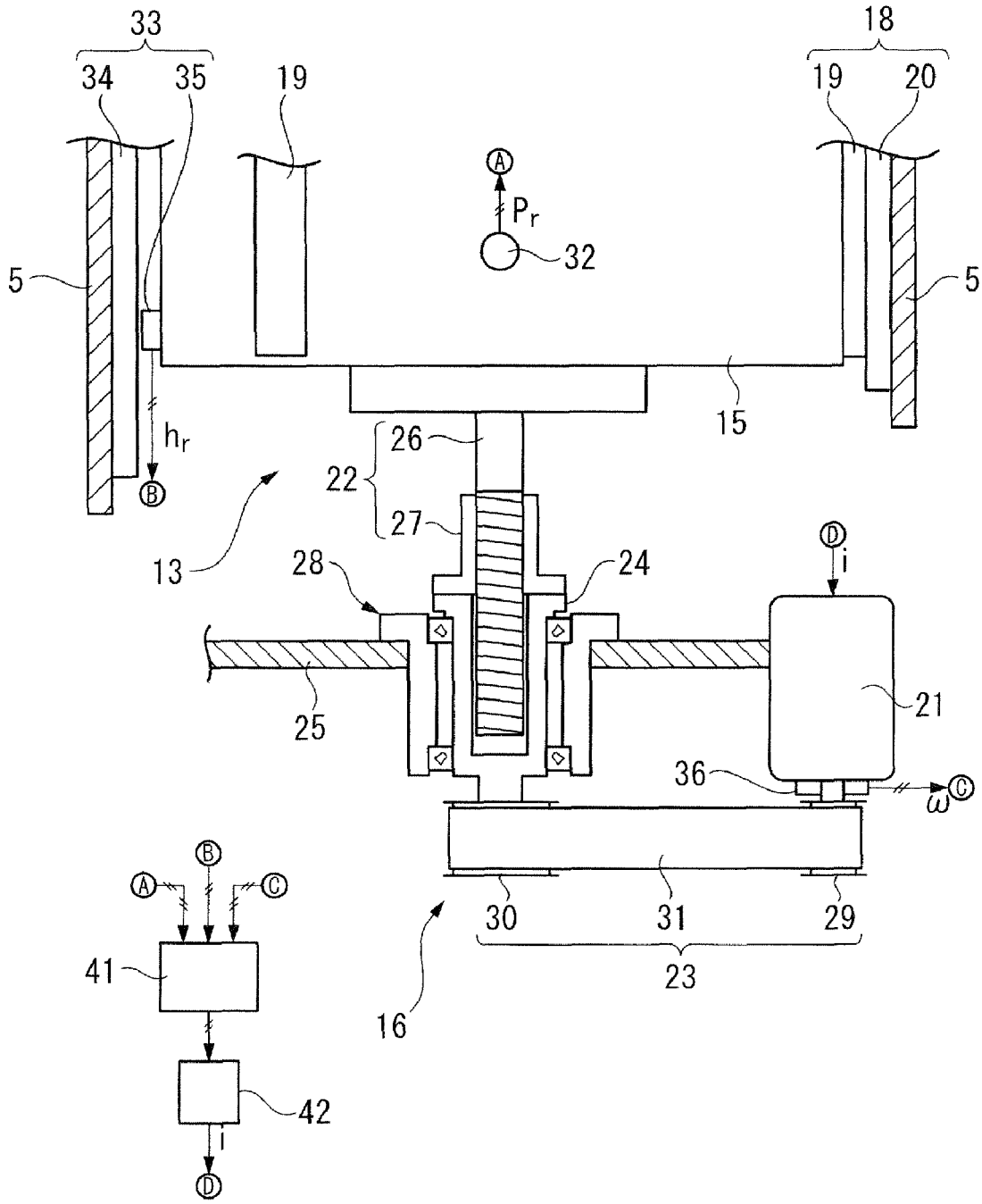
FIG. 11 is a schematic structural view of a die cushion according to a second embodiment of the present invention.
Figure 12:
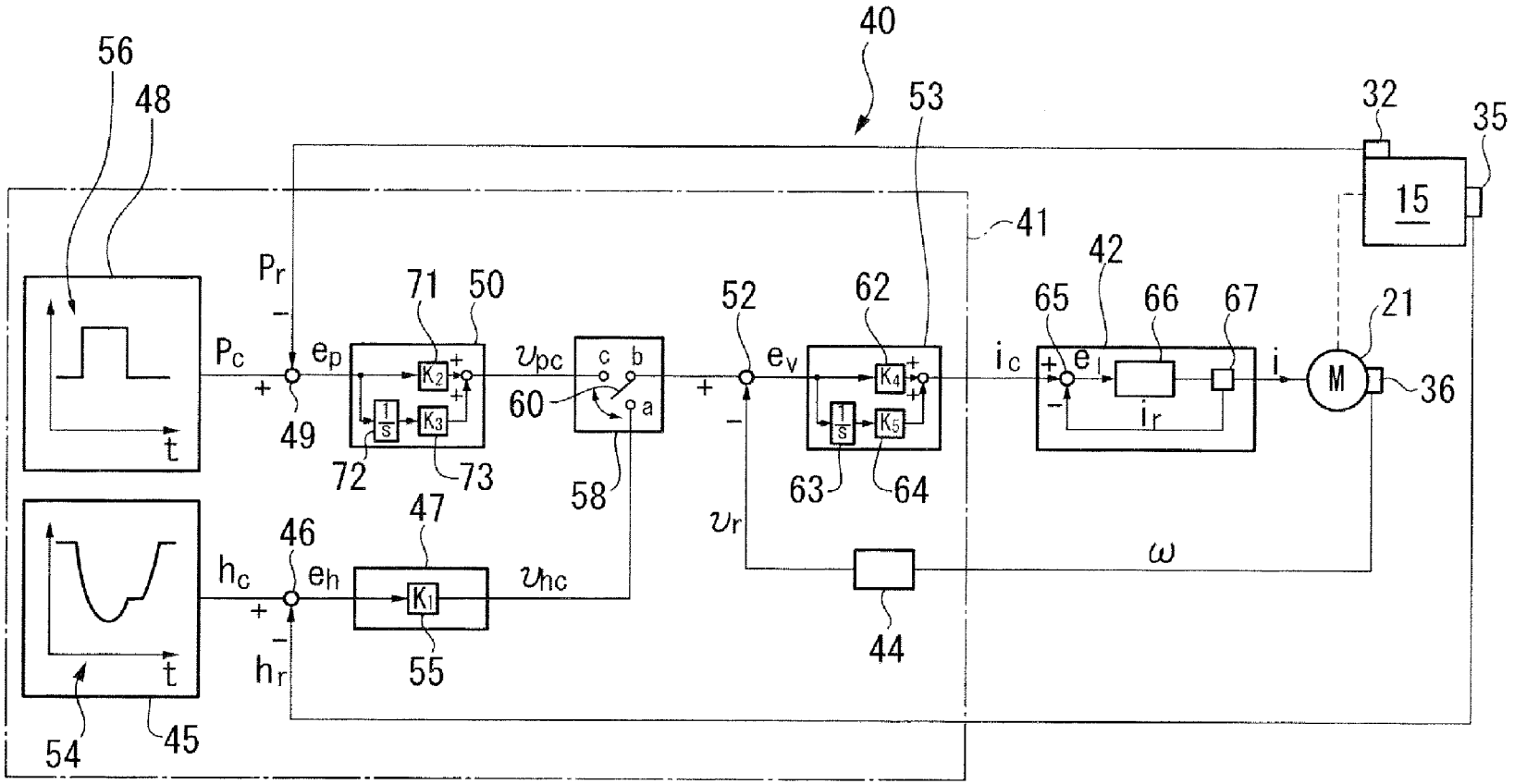
FIG. 12 is a block diagram illustrating a structure of a die cushion controller according to the second embodiment.

FIG. 11 is a schematic structural view of a die cushion according to a second embodiment of the present invention. FIG. 12 is a block diagram illustrating the construction of the die cushion controller of this embodiment. In this embodiment, the components that are the same as or similar to those of the first embodiment are indicated by the same reference numerals and a detailed description thereof will be omitted. The following description will focus on the differences between the first and second embodiments.

In the die cushion 13 of this embodiment, the upper end portion of the screw portion 26 of the ball screw mechanism 22 is connected with the lower end portion of the die cushion pad 15, and the plunger rod 80 forming the hydraulic chamber 83 as in the first embodiment, the hydraulic circuit that supplies pressure oil to the pressure chamber 83 and the like are not provided. The pressure gage 93 is not provided, either. Thus, a strain gage 32 is attached to a side surface of the die cushion pad 15, and the strain gage 32 detects the load (the cushion pressure) generated in the die cushion pad 15 to output the detection value to the controller 41 as the pressure detection signal Pr.

Further, between the die cushion pad 15 and the bed 5, there is provided a linear scale 33 that detects the position of the die cushion pad 15. The linear scale 33 includes a scale portion 34 and a head portion 35. The scale portion 34 is attached to a predetermined position of the inner wall surface of the bed 5 and the head portion 35 is attached to a side surface of the die cushion pad 15 so as to be close to the scale portion 34, so that the head portion 35 can move along the scale portion 34 as the die cushion pad 15 ascends and descends.

The head portion 35 outputs a die cushion pad position detection signal hr corresponding to the position of the die cushion pad 15. The die cushion pad position detection signal hr output from the head portion 35 is input to the controller 41. Thus, according to this embodiment, no motor rotation angle detection signal θ is output from the encoder 36 provided to the electric servomotor 21 as in the first embodiment, and only the motor rotation angular velocity detection signal ω is output to be input to the controller 41.

The pressure pattern 56 and the like used in pressure feedback control are the same as those of the first embodiment, and this embodiment can also provide the same effects as those of the first embodiment.

The present invention is not restricted to the above-mentioned embodiments but includes another arrangement and the like as long as an object of the present invention can be achieved, and the following modifications and the like are also included in the scope of the invention.

Figure 13:
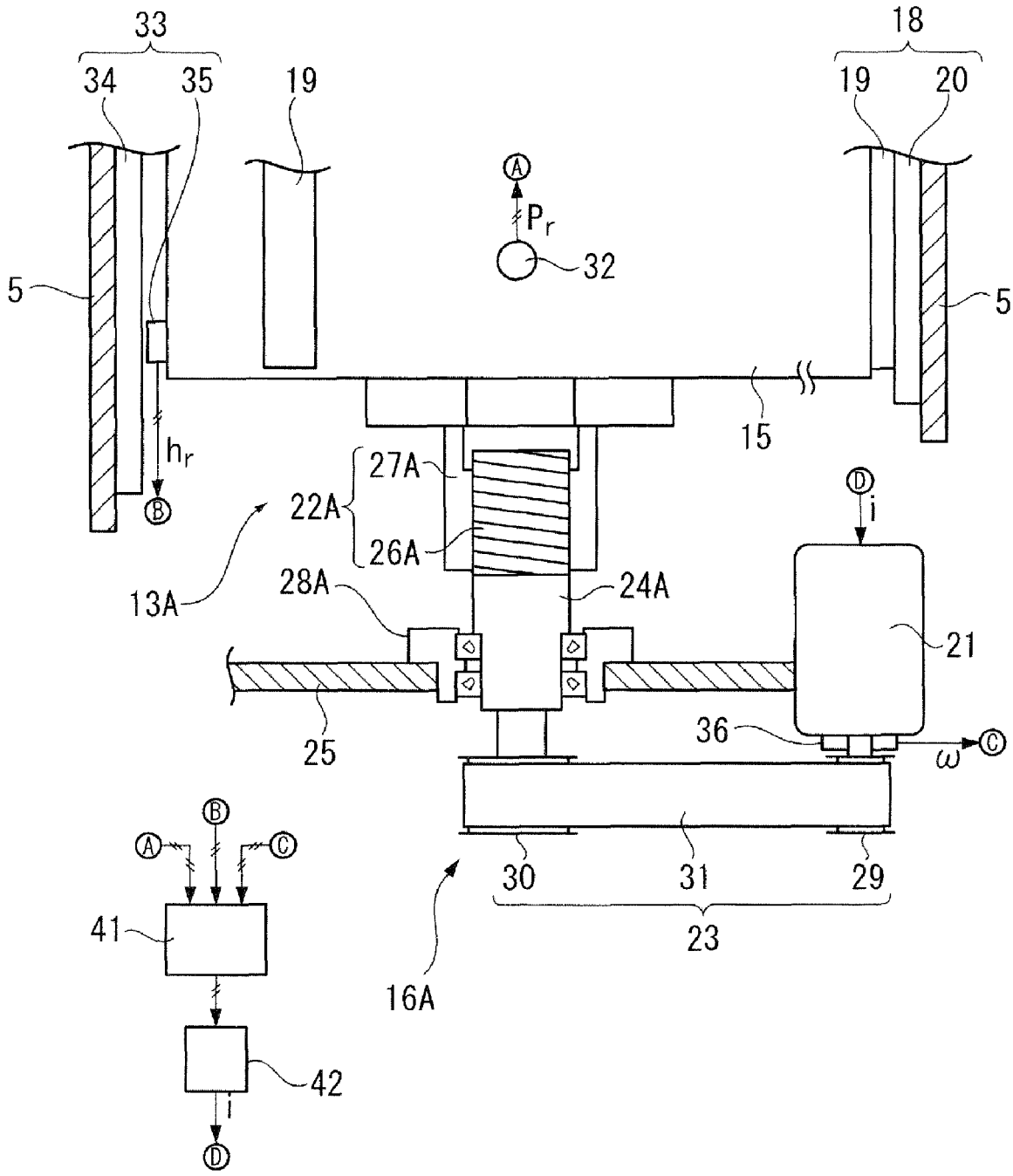
FIG. 13 is a diagram illustrating a first modification of the die cushion.

For example, in place of the die cushion 13 of the above-mentioned embodiments, it is also possible to adopt a die cushion 13A as shown in FIG. 13 (in which the components that are the same as or similar to those of the die cushion 13 are indicated by the same reference numerals) (first modification). In a die cushion pad driving mechanism 16A of the die cushion 13A, a nut portion 27A of a ball screw mechanism 22A is connected to the lower end portion of the die cushion pad 15, and a screw portion 26A threadedly engaged with the nut portion 27A is connected to the large pulley 30 via a connecting member 24A. The other arrangements of the die cushion of this modification are the same as the die cushion 13 of the second embodiment.

Figure 14:
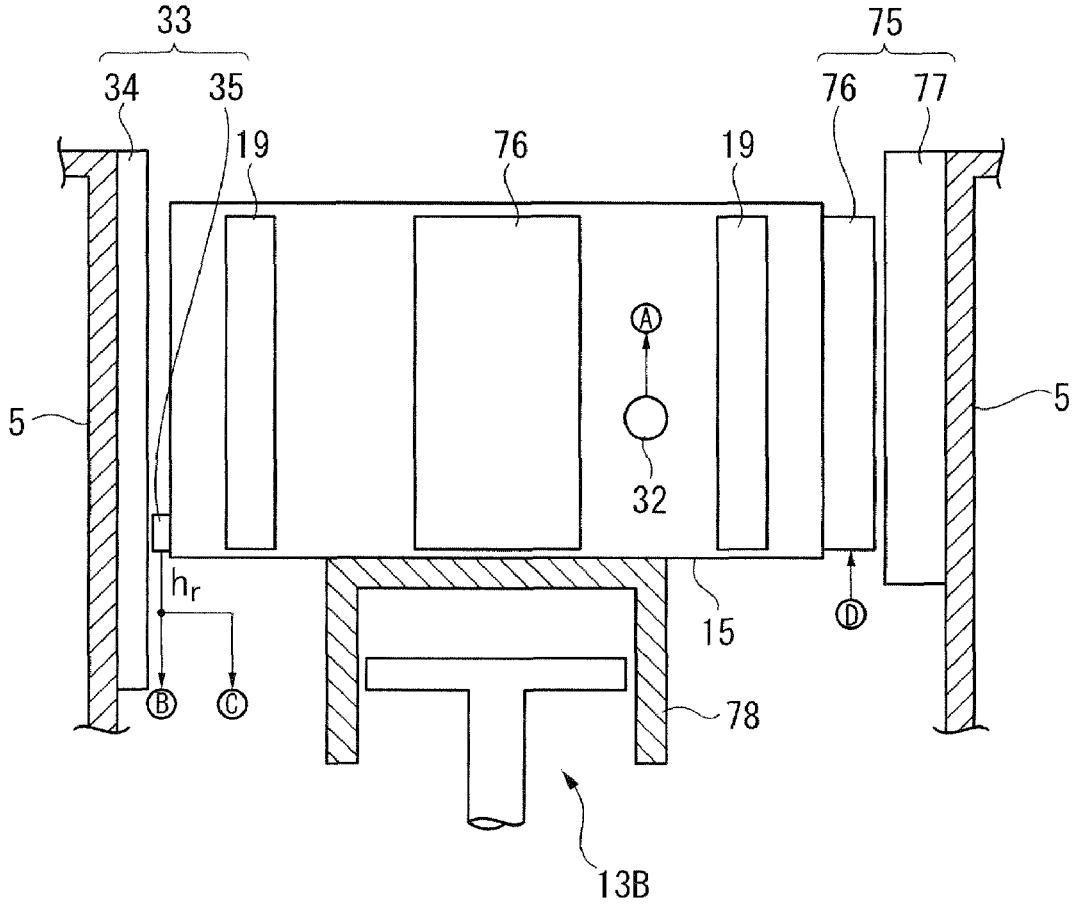
FIG. 14 is a diagram illustrating a second modification of the die cushion.
Figure 14:
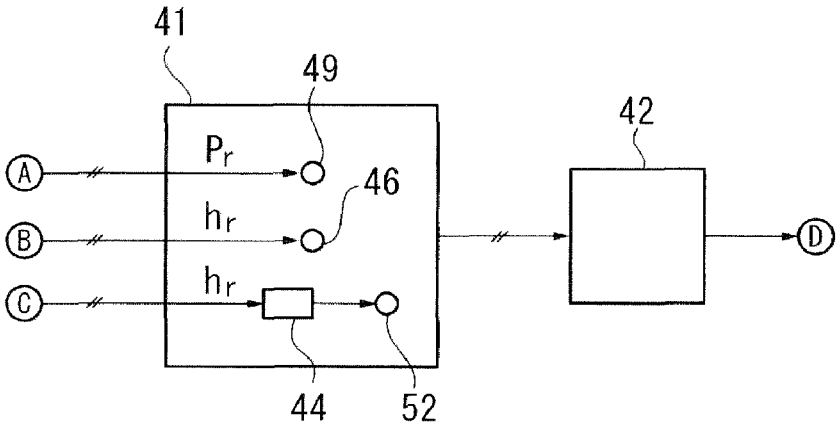
Figure 15:
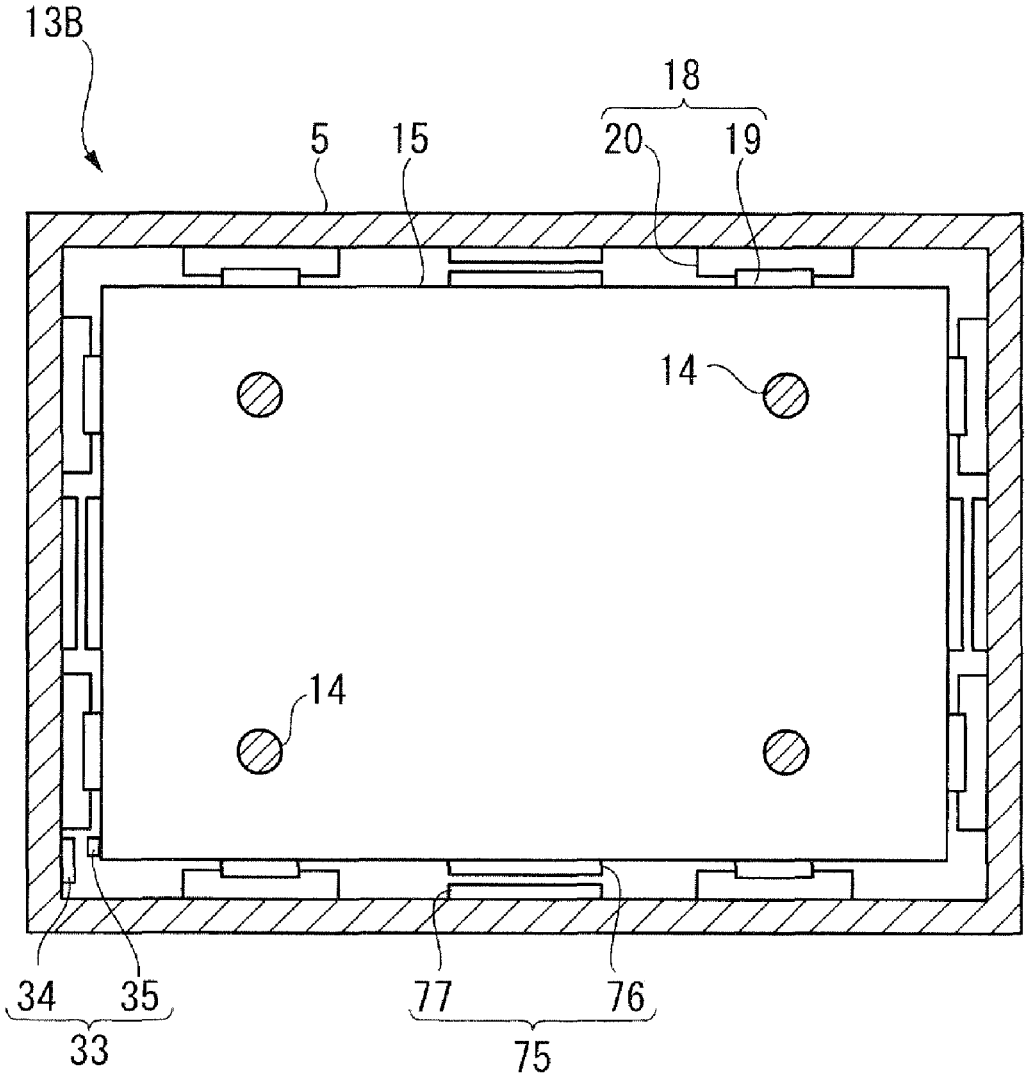
FIG. 15 is a diagram illustrating another portion of the second modification.

Further, in place of the die cushion 13 of the above-mentioned embodiments, it is also possible to adopt a die cushion 13B as shown in FIGS. 14 and 15 (in which the components that are the same as or similar to those of the die cushion 13 are indicated by the same reference numerals) (second modification). In the die cushion 13B, a linear servomotor (electric servomotor) 75 is provided between each side surface of the die cushion pad 15 and the inner wall surface of the bed 5 opposed thereto. The linear servomotor 75 includes a pair of coil portion 76 and magnet portion 77. The coil portion 76 is provided on each side surface of the die cushion pad 15, and the magnet portion 77 is provided to the inner wall surface of the bed 5. However, it is also possible to provide the magnet portion 77 on each side surface of the die cushion pad 15 and to provide the coil portion 76 to the inner wall surface of the bed 5.

In the die cushion 13B, in the case in which the coil portions 76 are provided to the die cushion pad 15, when the coil portions 76 are excited, an attractive force and a repulsive force are exerted between the coil portions 76 and the magnet portions 77, so that the coil portions 76 and the die cushion pad 15 receive a biasing force in the ascending/descending direction. In the case in which the magnet portions 77 are provided to the die cushion pad 15, when the coil portions 76 are excited, an attractive force and a repulsive force are exerted between the coil portions 76 and the magnet portions 77, so that the magnet portions 77 and the die cushion pad 15 receive a biasing force in the ascending/descending direction. When the supply current to the coil portions 76 is controlled, the biasing force imparted to the die cushion pad 15 (the cushion pressure generated in the die cushion pad 15) is controlled.

In the die cushion 13B, there is provided under the die cushion pad 15 a pneumatic balancer 78 including a piston and a cylinder. Although not shown, the lower portion of the piston of the balancer 78 is supported by the beam 25 (FIG. 1). Thus, the die cushion pad 15 is supported by the beam 25 with interposition of the balancer 78, so that even when the power source of the linear servomotor 75 is cut off to generate no magnetic force between the coil portions 76 and the magnet portions 77, there is no fear of a falling of the die cushion pad 15.

The die cushion controller 40 can be applied to a control system for the die cushion 13B. However, due to the structural differences between the rotary servomotor and the linear servomotor, there are some differences in motor speed feedback control system. That is, the die cushion pad speed computing unit 44 of this modification inputs the die cushion pad position detection signal hr from the head portion 35 of the linear scale 33 for the die cushion pad position detection, the die cushion pad speed computing unit 44 differentiating the input signal with respect to time to obtain the speed of the die cushion pad 15 and output the speed to the speed comparing unit 52 as the die cushion pad speed detection signal υr.

According to the die cushion 13B, the power transmission between the linear servomotor 75 and the die cushion pad 15 is effected not through mechanical contact using engagement members such as gears, belt and ball screw but in a non-contact manner using magnetic force, so that it is possible to efficiently reduce mechanical noise during power transmission. Further, as compared with the case in which the rotary servomotor is used, the number of components is reduced, thereby facilitating the maintenance.

Although the pressure control is effected in the period of time from time t2 to time t3 in which drawing is actually performed and the position control is effected in the other period of time in the above-mentioned embodiments, it is also possible to effect the pressure control in the other period of time. In other words, in the present invention, switching to the position control is not indispensable.

Further, in effecting the pressure control, control is effected according to a preset pressure pattern, so that it may be arbitrarily decided whether or not a pressure detection signal Pr is detected and fed back.

The above-described best arrangement, method and the like for carrying out the present invention should not be construed restrictively. That is, while illustrated and described mainly in relation to the particular embodiments, the present invention allows those skilled in the art to make various modifications on the above-mentioned embodiments in terms of configuration, amount and other details without departing from the scope of technical idea and objective of the present invention.

Thus, the above disclosure with limitations in terms of configuration, amount or the like is only given to facilitate the understanding of the present invention, and should not be construed restrictively. Therefore, any description given with reference to members named with partial or no limitations in terms of configuration, amount or the like is to be covered by the scope of the present invention.

INDUSTRIAL APPLICABILITY

The present invention is applicable to a die cushion controller that controls a die cushion used in a pressing machine for drawing or the like. In particular, the invention can be suitably used as a die cushion controller for a die cushion driven by an electric servomotor.

The invention claimed is:

1. A die cushion controller, comprising:

a pressure command signal output unit that outputs a pressure command signal in accordance with a pressure target value based on a predetermined pressure pattern;

a pressure control unit that outputs a speed command signal based on the pressure command signal output from the pressure command signal output unit;

a speed control unit that outputs a motor current command signal based on the speed command signal output from the pressure control unit; and a servo amplifier that supplies an electric current to an electric servomotor which drives a die cushion, in accordance with the motor current command signal output from the speed control unit;

wherein the pressure target value of the predetermined pressure pattern includes:

a low pressure target value which is provided for a predetermined period of time after a die attached to a slide of a press machine touches a workpiece and during which pressure of the die cushion exceeds the low pressure target value;

a high pressure target value corresponding to a cushion pressure required for retaining the workpiece in contact with the die, the cushion pressure converging to the high pressure target value; and a complementary target value that starts at the low pressure target value, ends at the high pressure target value, and extends at a substantially linear increase rate therebetween for a predetermined period of time during which the cushion pressure exceeds the low pressure target value and reaches the high pressure target value.

2. The die cushion controller according to claim 1, wherein the low pressure target value is higher than a preload pressure applied before the die touches the workpiece and is set so that a low pressure side maximum pressure that is assumed to be caused when the cushion pressure is converged to the low pressure target value is lower than the high pressure target value.

* * * * *

UNITED STATES PATENT AND TRADEMARK OFFICE

CERTIFICATE OF CORRECTION

PATENT NO. : 7,739,894 B2
APPLICATION NO. : 11/908488
DATED : June 22, 2010
INVENTOR(S) : Yuichi Suzuki It is certified that error appears in the above-identified patent and that said Letters Patent is hereby corrected as shown below:

On the title page:

Item (73) Assignee;

after "Komatsu Ltd., Tokyo (JP)" insert --Komatsu Industries Corp., Ishikawa (JP)--.

Signed and Sealed this
Fifteenth Day of February, 2011

David J. Kappos

David J. Kappos
*Director of the United States Patent and Trademark Office*